US009840929B2

(12) United States Patent
Barnett

(10) Patent No.: US 9,840,929 B2
(45) Date of Patent: Dec. 12, 2017

(54) GAS TURBINE ENGINE VANE ASSEMBLY AND METHOD OF MOUNTING SAME

(71) Applicant: Pratt & Whitney Canada Corp., Longueuil (CA)

(72) Inventor: Barry Barnett, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 980 days.

(21) Appl. No.: 13/903,312

(22) Filed: May 28, 2013

(65) Prior Publication Data

US 2014/0356158 A1 Dec. 4, 2014

(51) Int. Cl.
*F01D 9/04* (2006.01)

(52) U.S. Cl.
CPC ..... *F01D 9/042* (2013.01); *Y10T 29/49321* (2015.01)

(58) Field of Classification Search
CPC . F01D 9/041; F01D 9/042; F01D 9/04; F05D 2240/11; F05D 2240/12; F05D 2240/125; F05D 2260/30; F05D 2260/36; F05D 2260/37; F05D 2260/38; Y10T 29/49321
See application file for complete search history.

(56) References Cited

U.S. PATENT DOCUMENTS 2,812,159 A * 11/1957 Krebs ..... F01D 9/042 415/119
2,857,093 A * 10/1958 Warnken ..... F01D 9/042 415/200
2,914,300 A * 11/1959 Sayre ..... F01D 9/042 415/135
3,501,247 A 3/1970 Tournere
3,588,267 A * 6/1971 Turnditch et al. ..... F01D 9/044 415/135
3,778,185 A * 12/1973 Plowman ..... F02C 7/20 138/37
3,836,282 A * 9/1974 Mandelbaum ..... F01D 9/042 415/209.4
4,195,638 A * 4/1980 Duckstein ..... A61J 17/00 229/5.5
4,249,859 A * 2/1981 Benyi, Jr. ..... F01D 9/04 415/137
4,378,961 A * 4/1983 Trousdell ..... F01D 9/042 415/137
4,575,911 A * 3/1986 Laszlo ..... B23K 1/0018 228/234.1
4,594,761 A * 6/1986 Murphy ..... B23P 15/04 29/418
4,655,682 A * 4/1987 Kunz ..... F01D 9/042 415/119
4,728,258 A * 3/1988 Blazek ..... B22C 9/04 164/35

(Continued)

*Primary Examiner* — Craig Kim
*Assistant Examiner* — Wayne A Lambert
(74) *Attorney, Agent, or Firm* — Norton Rose Fulbright Canada LLP

(57) ABSTRACT

The gas turbine engine vane assembly has a vane having an elongated airfoil body extending to a tip and a grommet disposed around the tip. An insert having a closed loop shape with an inner surface matingly shaped to receive the outer surface of the grommet, and an outer surface matingly shaped to be snugly received in the slot. A method of mounting such a vane assembly is also disclosed.

17 Claims, 7 Drawing Sheets

(56) References Cited

U.S. PATENT DOCUMENTS 4,820,120 A * 4/1989 Feuvrier ..... F01D 9/042 415/189
4,832,568 A 5/1989 Roth et al.
4,940,386 A * 7/1990 Feuvrier ..... F01D 9/04 415/189
4,956,139 A * 9/1990 Koizumi ..... B29C 45/14221 264/154
4,987,944 A * 1/1991 Parks ..... B22C 9/04 164/10
5,074,752 A * 12/1991 Murphy ..... F01D 9/042 415/119
5,083,900 A * 1/1992 Carletti ..... F01D 9/042 415/191
5,226,789 A * 7/1993 Donges ..... F01D 9/042 415/173.4
5,272,869 A 12/1993 Dawson et al.
5,474,419 A * 12/1995 Reluzco ..... F01D 9/044 415/209.4
5,494,404 A 2/1996 Furseth et al.
5,547,342 A 8/1996 Furseth et al.
5,609,467 A * 3/1997 Lenhart ..... F01D 9/065 415/142
5,672,405 A * 9/1997 Plank, Jr. ..... B29C 45/14311 264/273
5,765,993 A * 6/1998 Weiss ..... B23P 6/005 29/889.1
6,409,472 B1 * 6/2002 McMahon ..... F01D 5/3023 415/119
6,543,995 B1 * 4/2003 Honda ..... F01D 9/041 415/189
6,543,998 B1 * 4/2003 Scharl ..... F01D 9/044 415/191
6,595,747 B2 * 7/2003 Bos ..... F04D 29/542 415/209.2
6,619,917 B2 * 9/2003 Glover ..... F01D 9/042 29/889.22
7,086,831 B2 8/2006 Harper
7,413,400 B2 8/2008 Barnett
7,479,246 B2 * 1/2009 Muteau ..... B29C 44/385 264/218
7,494,316 B2 2/2009 Barnett et al.
7,510,372 B2 * 3/2009 Bogue ..... F01D 5/005 415/191
7,530,782 B2 5/2009 Barnett et al.
7,614,848 B2 * 11/2009 Bogue ..... B23P 6/005 29/888.022
7,628,578 B2 12/2009 Barnett et al.
7,637,718 B2 12/2009 Barnett et al.
7,665,963 B2 * 2/2010 Bogue ..... F01D 5/005 29/888.02
7,761,990 B2 * 7/2010 Ellis ..... B23P 6/005 29/889.1
8,714,920 B2 * 5/2014 Campbell ..... B22D 19/00 415/191
2006/0067817 A1 * 3/2006 Motherwell ..... F01D 9/042 415/191
2007/0098548 A1 * 5/2007 Barnett ..... F01D 9/042 415/209.3
2007/0098557 A1 * 5/2007 Barnett ..... F01D 9/042 416/193 A
2009/0169375 A1 * 7/2009 Cortequisse ..... F01D 5/141 415/208.1
2010/0254804 A1 10/2010 Harper
2011/0081240 A1 * 4/2011 Durocher ..... F01D 9/044 415/209.3
2011/0297344 A1 * 12/2011 Campbell ..... B22C 9/10 164/98
2012/0070270 A1 * 3/2012 Ravey ..... F01D 5/16 415/119
2012/0189438 A1 * 7/2012 Feigleson ..... F01D 9/042 415/189
2012/0251313 A1 10/2012 Eleftheriou et al.

* cited by examiner

GAS TURBINE ENGINE VANE ASSEMBLY AND METHOD OF MOUNTING SAME

TECHNICAL FIELD

The application relates generally to gas turbine engines and, more particularly, to gas turbine engine vane assemblies.

BACKGROUND

During assembly, gas turbine engine vanes are typically inserted into position in their casing via a corresponding slot in an outer case and then slid radially-inwardly into place, such that the vane extends radially between the inner and outer cases. A wider portion at the end or root of the vane acts as a stop, which abuts against the outer case and holds the vane in the radially-inward direction. The vane may be held in the radially-outward direction using a belt surrounding the outer case and vanes.

Especially at the fan outer case, it may be desirable to provide a seal between the root of the vane and the casing slot, to reduce pressure loss. It is therefore known to use a grommet made of a resilient material around the vane root to provide such a seal. The fore and aft edges of the vanes are relatively sharp, and thus vanes having enlarged step or flange portions having a blunter shape have been used for receipt within the grommet. Improvements of these solutions remain sought, to further reduce weight and improve ease of manufacture.

SUMMARY

There is provided a vane assembly mountable within a slot in an case of a gas turbine engine, the vane assembly comprising: a vane having an elongated airfoil body extending to a tip, and a grommet disposed around the tip, the grommet being of a material more resilient than a material of the airfoil body, the grommet having an outer surface surrounding the tip, a radially-inner surface and a radially-outer surface; and an insert having a closed loop shape with a radially-outer edge and a radially-inner edge, the closed loop shape having an inner surface matingly shaped to receive the outer surface of the grommet, and an outer surface matingly shaped to be snugly received in the slot, wherein one of the radially-outer edge and the radially-inner edge has an outwardly protruding lip shaped to abuttingly and sealingly engage a corresponding surface of the case around the slot, and the other one of the radially-inner edge and the radially-outer edge having hooks being resilient and inwardly flexible to engage the insert into one end of the slot, the hooks biased outwardly for engaging with a corresponding feature of the case, the insert being thereby trapped in the slot in position to snugly receive the grommet therein in a sealed engagement.

There is also provided a method of mounting a vane to a slot provided in a fan case of a turbofan gas turbine engine, the method comprising: inserting an insert into one end of the slot, flexing hooks of the insert and sliding the hooks out an other end of the slot, the hooks then engaging onto one face of the fan case with an outwardly protruding lip of the insert abutting against an opposite face of the fan case, the insert having an inner opening extending across the fan case and having an inner surface; and inserting an airfoil body of a vane through the inner opening of the insert and sliding the vane body radially inwardly until a grommet provided integral to a tip of the vane comes snugly into sealed engagement with the inner surface of the insert.

There is further provided a gas turbine engine having at least one compressor vane assembly having a plurality of vanes extending radially between an outer case and an inner case of the compressor and protruding into corresponding slots in the case, each vane assembly comprising: a vane having an elongated airfoil body extending to a tip, and a grommet disposed at the tip, the grommet being of a material more resilient than a material of the airfoil body, the grommet having an outer surface surrounding the tip, a radially-inner surface and a radially-outer surface; and an insert having a closed loop shape with a radially-outer edge and a radially-inner edge, the closed loop shape having an inner surface matingly shaped to receive the outer surface of the grommet, and an outer surface matingly shaped to be snugly received in the slot, wherein one of the radially-outer edge and the radially-inner edge has an outwardly protruding lip shaped to abuttingly and sealingly engage a corresponding surface of the case around the slot, and the other one of the radially-inner edge and the radially-outer edge having hooks being resilient and inwardly flexible for engaging the insert into one end of the slot, the hooks being biased outwardly for snapping onto a corresponding feature of the case, the insert being thereby trapped in the slot in position to snugly receive the grommet therein in a sealed engagement.

In another aspect, there is further still provided a vane assembly mountable to a slot in an fan case of a turbofan gas turbine engine, the vane assembly comprising: a vane having an elongated airfoil body extending to a tip, and a grommet made integral to the tip, the grommet being of a material more resilient than a material of the airfoil body, the grommet having an outer surface surrounding the tip and being snugly engageable with the slot.

Further details of these and other aspects of the present invention will be apparent from the detailed description and figures included below.

DESCRIPTION OF THE DRAWINGS

Reference is now made to the accompanying figures, in which.

DETAILED DESCRIPTION

Figure 1:
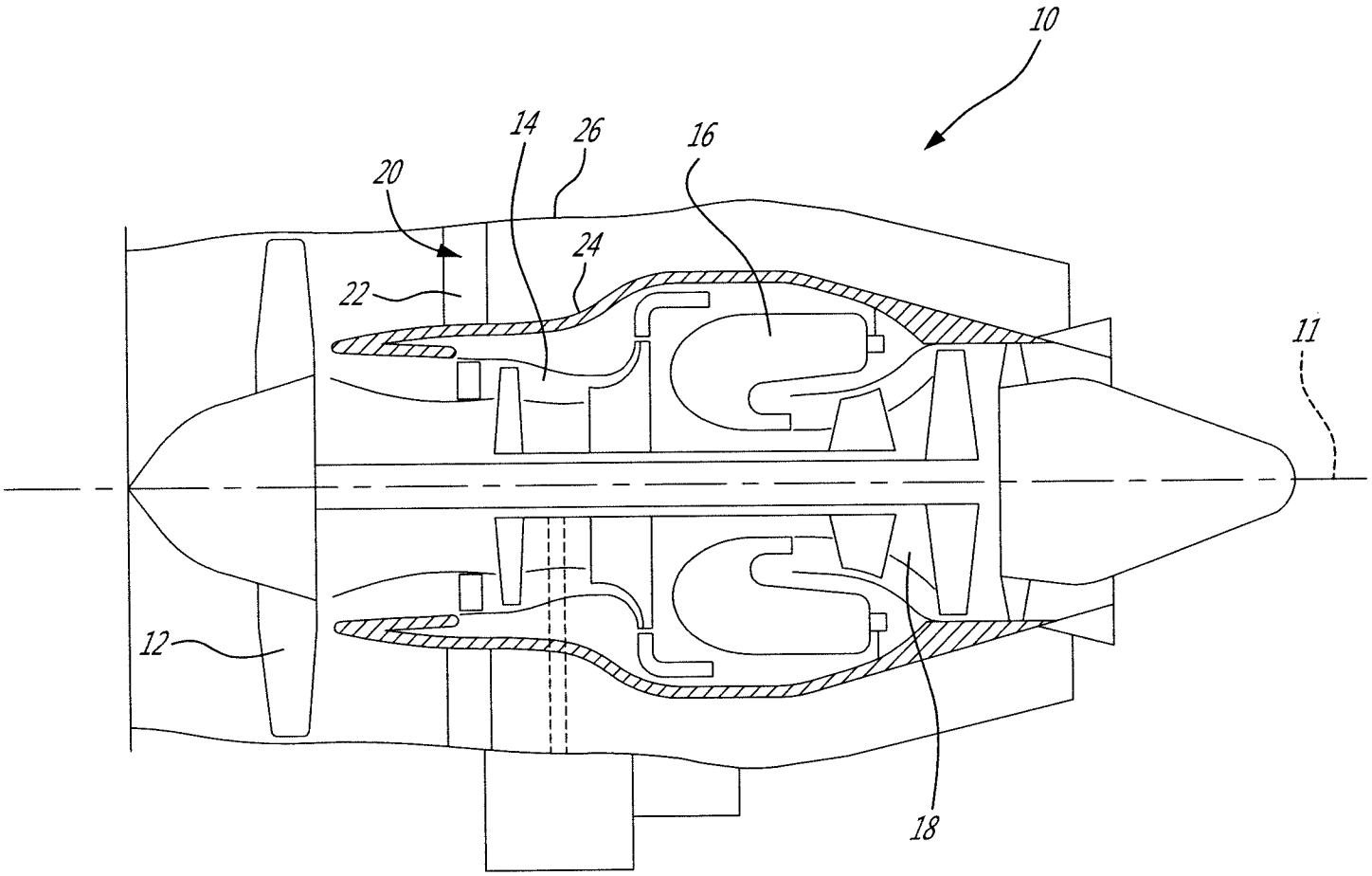
FIG. 1 is a schematic cross-sectional view of a gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
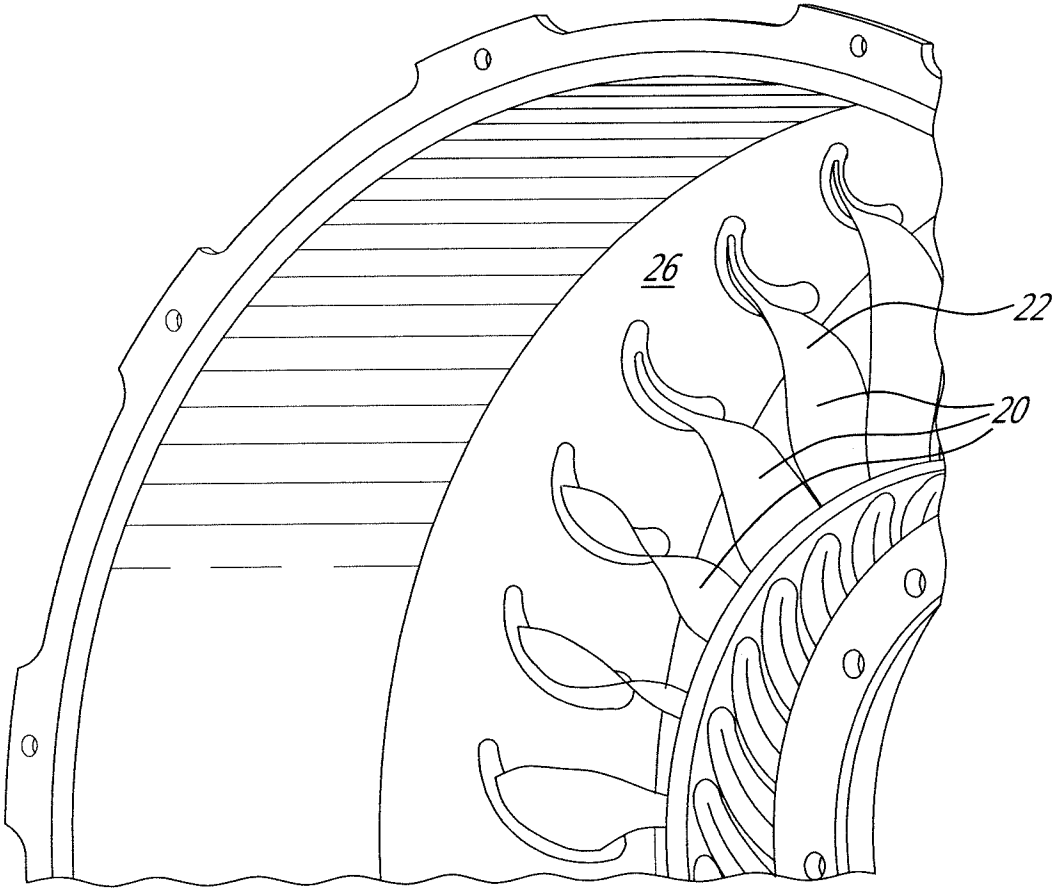
FIG. 2 is a schematic oblique view showing vane tips extending into slots in a fan outer case.
Figure 3:
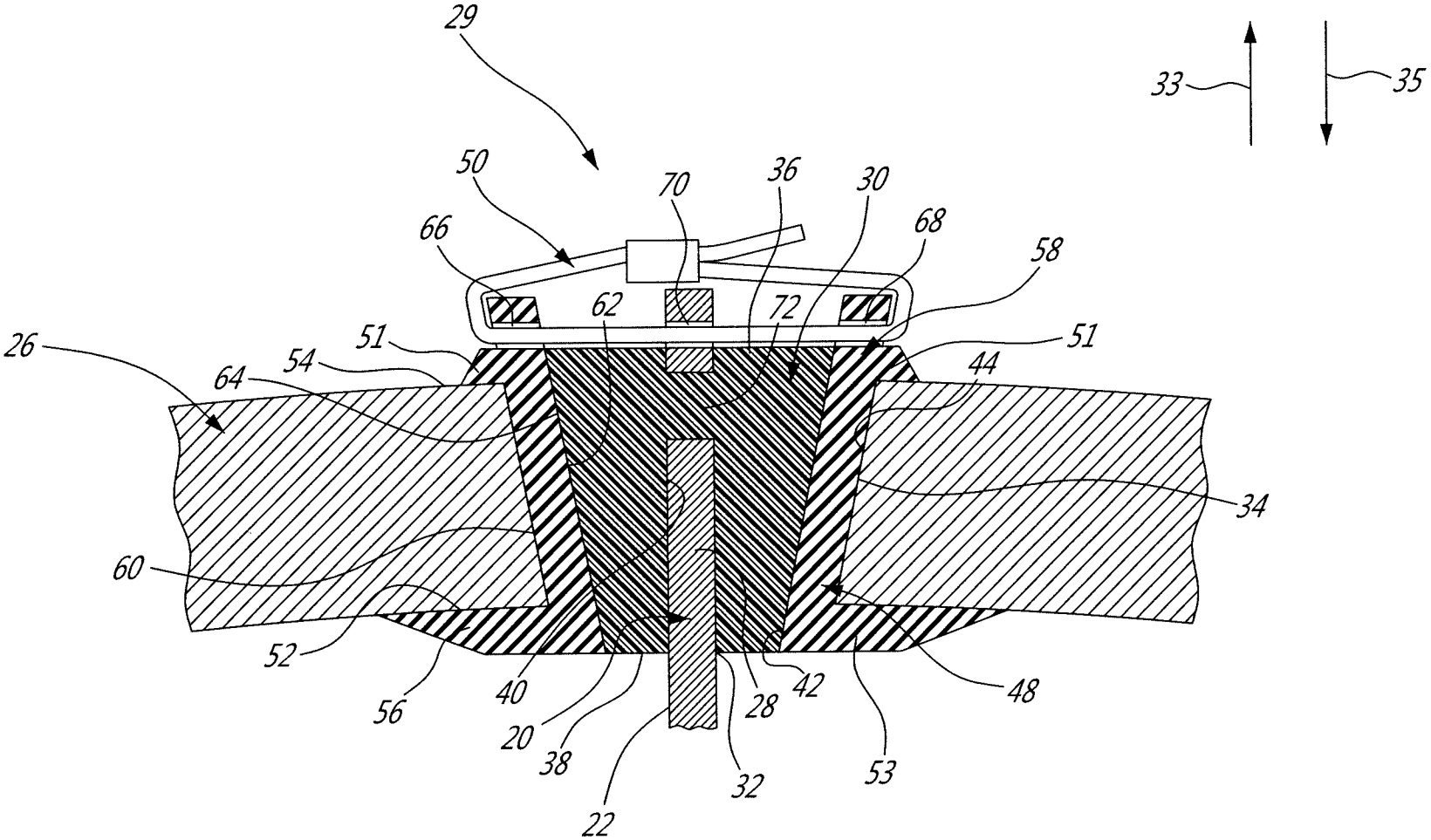
FIG. 3 is a schematic cross-sectional view of a first example of a portion of a vane assembly.

As best seen in FIG. 2, a plurality of vanes 20 are provided downstream of the fan 12 and are circumferentially interspaced from one another. The vanes 20 have an airfoil body 22 which extends radially between an inner case 24 and an outer case 26. A radially-outer tip 28 of the vane protrudes into the outer case 26 as best seen in FIG. 3.

A grommet 30 is made integral to the radially-outer vane tip 28. For instance, if the airfoil body 22 is made of injection moulded plastic such as PEEK (Polyether ether ketone) as is more and more common nowadays, this relatively brittle material can also be coated with a metal coating to enhance its structural properties. Alternately still, the grommet 30 can be co-moulded with the airfoil body 22 or the grommet can be potted (e.g. formed by dipping the vane tip into a grommet mould). The airfoil body 22 can alternately be made of aluminum or any other suitable material, for instance.

The grommet is characterized by being substantially more resilient than the material of the airfoil body 22, which is useful to form a satisfactory seal which will impede pressure loss in the radially-outward direction. The grommet 30 can be made of natural or synthetic rubber, or of polyurethane, to name a couple of examples. Since the grommet 30 is of a more resilient material than the airfoil body 22, and that the airfoil body 22 extends in a continuous manner to the tip 28, the presence of the does not cause high stress concentration areas at the interface 32 such as could be the case with a vane head made of a same material than the body.

Figure 11:
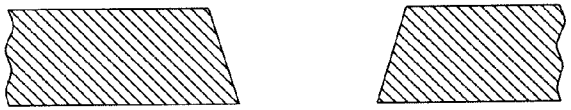
FIG. 11 is a schematic cross-sectional view of an alternate embodiment of a slot.

The vane tip 28 is held in the slot 34 via the grommet 30. The grommet 30 can be said to have a radially-outer surface 36, a radially-inner surface 38, an inner surface 40 in contact with the airfoil body 22, and an outer surface 42 surrounding the airfoil body 22. To resist the loads which can be expected during normal engine operation and in the event of a bird strike, the vane tip 28 should be held in the slot 34 not only in the plane of the fan case 26, but also in both the radially outward 33 and the radially inward 35 directions. The outer surface 42 can be made to snugly adapt directly to the inner surface 44 of the slot 34 which would allow the vane tip 28 to be held in the plane of the slot. Moreover, with the vanes typically being inserted into the duct externally, across the fan case 26 in the radially inner direction 35, the assembly could be made to support the grommet 30 in the radially-inward direction such as by using a radially-inward tapering shape in the slot 34 shown in FIG. 11 for instance, and an external device such as a fastener or belt be used to hold the vane tip 28 in the radially-outward direction and maintain the seal with the slot.

Henceforth, in this example, it was preferred to provide the vane tip assembly 29 with two additional components: an insert 48 and a fastener 50. More specifically, the insert 48 in this embodiment can be made of a somewhat resilient material, such as a plastic for instance, and provided generally in a closed loop shape with a base or outwardly protruding lip 53 at one edge 56 and hooks 51 at the opposite edge 58, and be engineered to be firmly pressed across the slot 34 from one side thereof (e.g. the radially inner side 52) with the hooks 51 resiliently yielding until the hooks 51 protrude out the other side (e.g. the radially-outer side 54) to snap into position against a corresponding feature of the case 26 such as a portion of an opposite face of the case 26 adjacent the slot 34, at which point the lip 53 provides a firm abutment against the other face of the case (e.g. side 52) with the slot trapped between the hooks 51 and the base 53, or, otherwise said, with the insert 48 engaging with the slot 34 such as to lock together.

The function of the snap hooks 51 are both to hold the insert 48 in place during the assembly of remainder of the parts and to prevent the vane and grommet 30 being ingested inwards during the impact due to foreign object damage.

Figure 4:
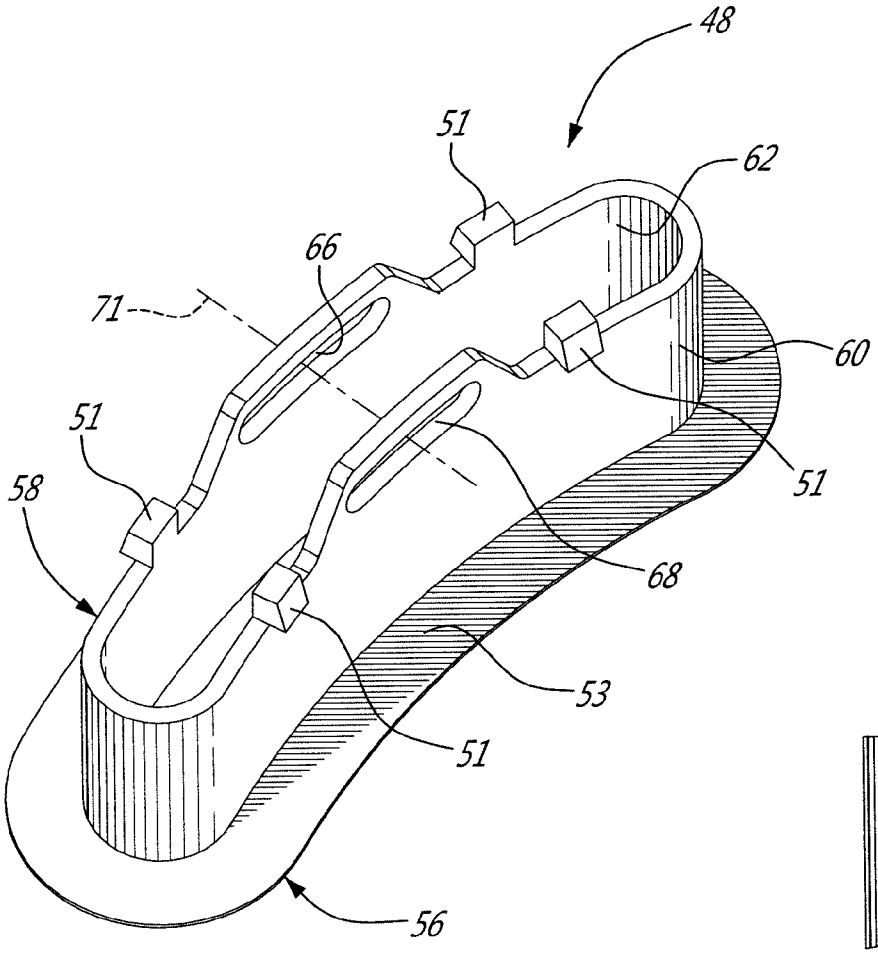
FIG. 4 is a schematic oblique view of an insert of the vane assembly of FIG. 3.
Figure 8:
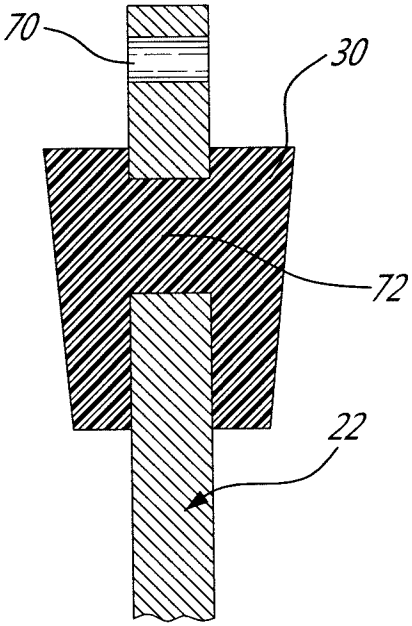
FIG. 8 is a schematic cross-sectional view of the vane tip and grommet of FIG. 3.

The exact shape of the insert 48 which was selected in this specific example is shown more clearly in FIG. 4. The closed-loop shape of the insert 48 can also be seen to include an outer surface 60 which is shaped to snugly engage the inner surface 44 of the slot 34, and an inner surface 62 which is shaped to snugly and sealingly receive an outer surface 64 of the grommet 30.

Moreover, the shape of the insert 48 can be freely designed, and it can be designed with fastener apertures 66, 68, for instance, the exact shape, number, position, and configuration of which can be freely adapted to the specifics of alternate embodiments.

Figure 12:
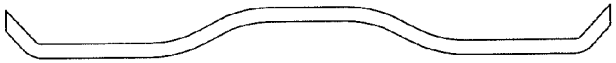
FIG. 12 is an alternate example of a fastener.
Figure 13:
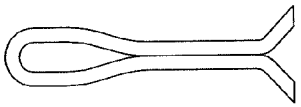
FIG. 13 is an alternate example of a fastener.

In the illustrated embodiment, the insert 48 has two fastener apertures 66, 68, both provided on the radially outer edge 58 of the insert 48, with one on each side of the grommet 30 when the grommet is in its working position, and aligned along a fastener axis 71. A fastener 50 can be inserted through both fastener apertures, and press radially-inwardly upon the radially-outward surface of the grommet or vane tip 28 to exert the retention of the vane tip 28 in the radially-outward direction. In the illustrated embodiment, the fastener is a simple tie-wrap attachment. In alternate embodiments, it can be a split pin or wave spring such as illustrated in FIG. 12 or 13, to name two alternate examples.

Figure 7:
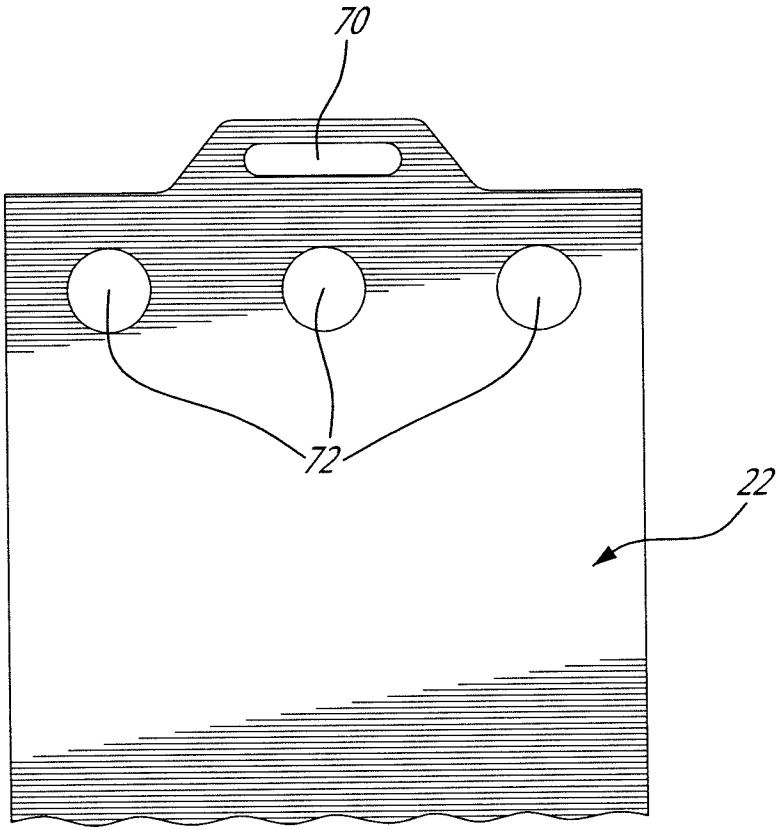
FIG. 7 is a side elevation view of a vane tip of the assembly of FIG. 3.

The specific configuration of the tip of the airfoil body 22 used in the illustrated embodiment is shown more clearly at FIG. 7, where it can be seen that the radially-outer end of the airfoil body 22 is also provided with a fastener slot 70 in this example, which can cooperate with the fastener 50 and the fastener slots 66, 68, and the tapered shape of the grommet and insert 48 to maintain the vane tip 28 in its working position even in the event of a bird strike or the like. More specifically, the fastener slot 70 is aligned with fastener slots 66 and 68 when the grommet is sealingly received in the insert 48. Moreover, in this specific embodiment, the radially-outer end of the airfoil body 22 is provided with apertures 72 through which the material of the grommet extends, which allows the grommet 30 to be firmly held against the airfoil body 22.

Figure 5:
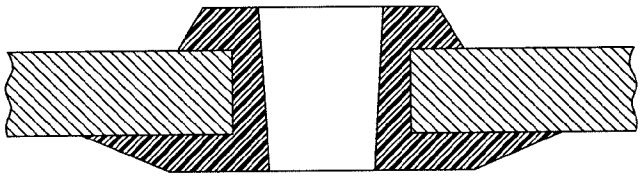
FIG. 5 is a schematic cross-sectional view showing the insert of FIG. 4 mounted to a slot.
Figure 6:
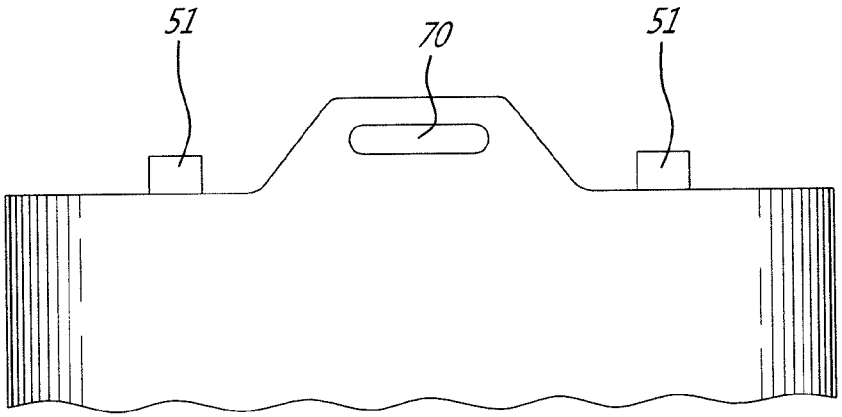
FIG. 6 is a side elevation view of a portion of the insert.

FIG. 5 shows an embodiment where the inner surface of the slot extends radially (non-tapered) but where the inner surface of the insert nevertheless extends tapered in the radially-inner direction.

Figure 9:
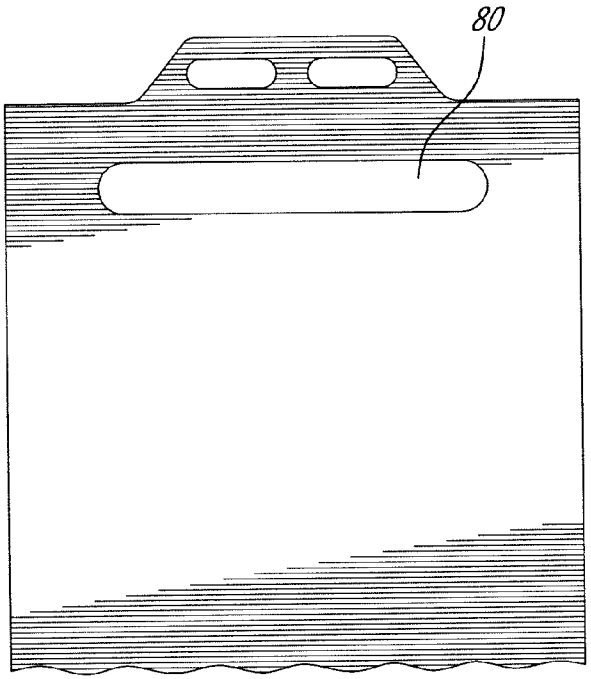
FIG. 9 is a schematic elevation view of an alternate embodiment of a vane tip.

FIG. 9 shows an embodiment where an elongated slot 80 is provided through the airfoil body 22 and across which the material of the grommet can extend. Furthermore, in the embodiment of FIG. 9, the fastener slots are of a number of two, showing that various alternate configurations are possible.

Figure 10:
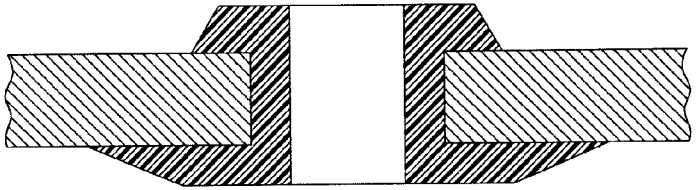
FIG. 10 is a schematic cross-sectional view of an alternate embodiment of an insert and slot assembly.

FIG. 10 shows an alternate embodiment where both the outer surface of the insert and the inner surface of the insert extend radially (i.e. non-tapered).

Figure 15:
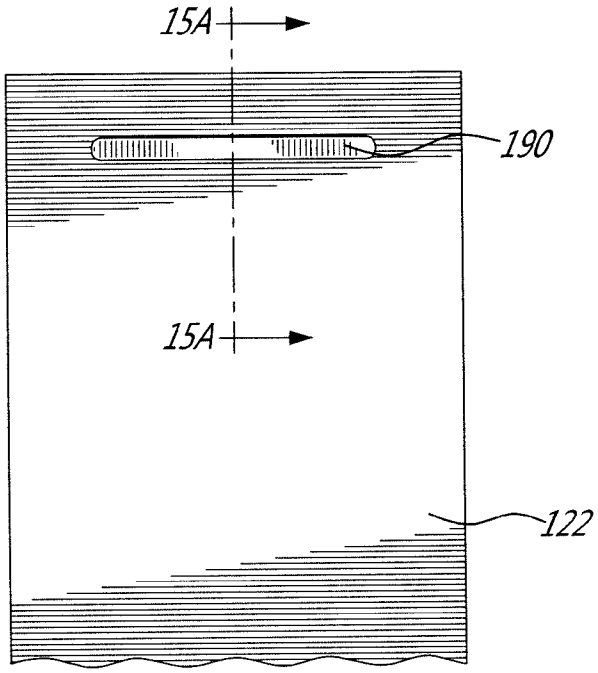
FIG. 15 is a schematic elevation view of the vane tip of FIG. 14 without the grommet.
Figure 15A:
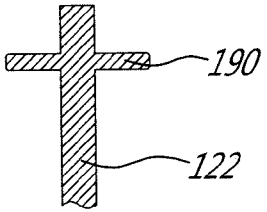
Figure 14:
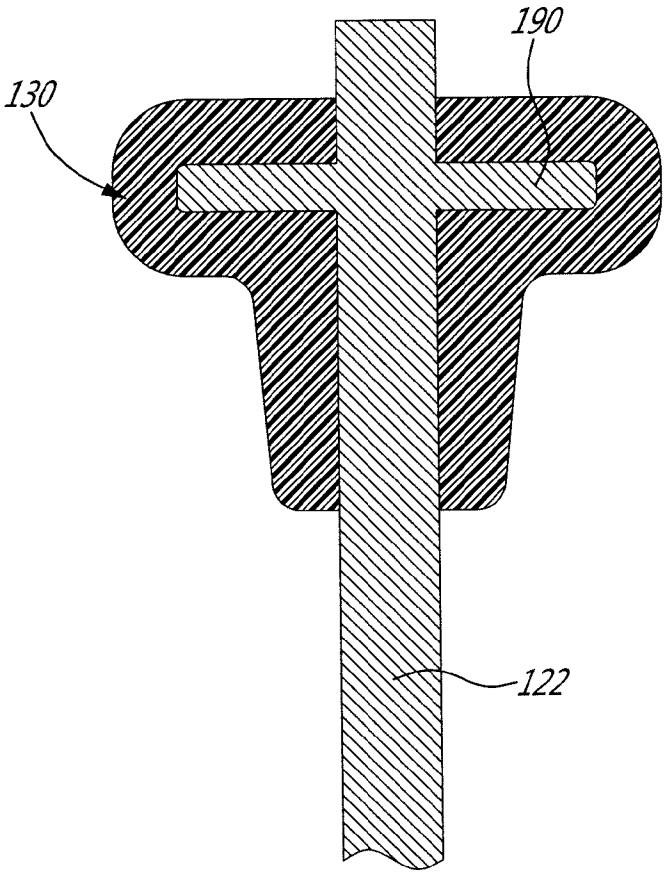
FIG. 14 is a schematic cross-sectional view of an alternate example of a vane tip and grommet assembly.

FIGS. 14 and 15 show an alternate embodiment where the vane body 122 is provided with laterally-extending wings 190 and where the grommet 130 is firmly secured to the vane body by way of the wings 190.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the scope of the appended claims.

What is claimed is:

1. A vane assembly mountable within a slot in a case of a gas turbine engine, the vane assembly comprising:

a vane having an elongated airfoil body extending to a tip at a radially outer extremity and a grommet disposed around the tip, the grommet being of a material more resilient than a material of the airfoil body, the grommet having an outer surface surrounding the tip, a radially-inner surface and a radially-outer surface, the tip of the vane having one or more apertures extending through the airfoil body, the material forming the grommet extending through the one or more apertures and being integrally formed therewithin, and one or more fastener slots extending through the tip of the airfoil body at a location radially outwardly from the one or more apertures, from the grommet and from the case;

an insert having a closed loop shape with a radially-outer edge and a radially-inner edge, the closed loop shape having an inner surface matingly shaped to receive the outer surface of the grommet, and an outer surface matingly shaped to be snugly received in the slot, wherein one of the radially-outer edge and the radially-inner edge has an outwardly protruding lip shaped to abuttingly and sealingly engage a corresponding surface of the case around the slot, and the other one of the radially-inner edge and the radially-outer edge having hooks being resilient and inwardly flexible to engage the insert into one end of the slot, the hooks biased outwardly for engaging with a corresponding feature of the case, the insert being thereby trapped in the slot in position to snugly receive the grommet therein in a sealed engagement, and the insert having at least two insert fastener apertures disposed on opposite sides of the closed loop shape and aligned along a fastener axis; and a fastener engaging both the vane and the insert when the grommet is snugly received in the sealed engagement, the fastener extending through the at least two insert fastener apertures and the one or more fastener slots in the tip of the vane that is disposed between the at least two insert fastener apertures, the one or more fastener slots being defined in a portion of the tip of the vane protruding radially-outward from the grommet.

2. The vane assembly of claim 1 wherein a mating shape of the grommet outer surface and of the insert inner surface forms a seat for the insert to support the grommet in position, and the fastener engaged with both the insert and the vane retains the grommet in said position.

3. The vane assembly of claim 2 wherein the mating shape of the grommet outer surface and of the insert inner surface is tapered radially-inwardly to support the grommet in the radially-inner direction and the fastener is positioned radially-outwardly from the case to support the grommet in the radially-outer direction.

4. The vane assembly of claim 2 wherein the mating shape of the grommet outer surface and of the insert inner surface is radially tapered to form the seat.

5. The vane assembly of claim 1 wherein the grommet is a potted grommet.

6. The vane assembly of claim 1 wherein the grommet is co-moulded to the tip of the airfoil body, within the one or more apertures extending through the airfoil body.

7. The vane assembly of claim 1 wherein the grommet extends on opposite sides of the tip and through the one or more apertures provided in the tip.

8. The vane assembly of claim 1 wherein the tip has wings and the grommet covers the wings.

9. The vane assembly of claim 1 wherein the tip is continuous to the airfoil body.

10. The vane assembly of claim 1 wherein the radially-inner edge of the insert has the lip.

11. The vane assembly of claim 1 wherein the outer surface of the insert and a corresponding inner surface of the slot are radially-tapered.

12. The vane assembly of claim 1 wherein the corresponding feature of the case is a portion of a surface of the case around the slot.

13. A method of mounting a vane to a slot provided in a fan case of a turbofan gas turbine engine, the method comprising:

inserting an insert into one end of the slot, flexing hooks of the insert and sliding the hooks out another end of the slot, the hooks engaging onto one face of the fan case and an outwardly protruding lip of the insert abutting against an opposite face of the fan case, the insert having an inner opening extending across the fan case and having an inner surface, the insert having a fastener aperture formed in a portion thereof protruding radially-outwardly from the fan case;

inserting an airfoil body of a vane through the inner opening of the insert and sliding the airfoil body of the vane radially inwardly until a grommet, integral to a tip of the vane by being integrally formed within one or more apertures extending through the airfoil body of the vane, comes snugly into sealed engagement with the inner surface of the insert; and using a fastener to engage both the vane and the insert together, the fastener extending through the fastener aperture of the insert and a vane fastener slot extending through the tip of the vane at a location radially outwardly from the one or more apertures, from the grommet and from the fan case, the vane fastener slot being defined in a portion of the tip of the vane protruding radially-outward from the grommet.

14. The method of claim 13 further comprising co-moulding the grommet to the tip of the vane.

15. The method of claim 13 further comprising potting the grommet to the tip of the vane.

16. A gas turbine engine having at least one compressor vane assembly having a plurality of vanes extending radially between an outer case and an inner case of the compressor and protruding into corresponding slots in the outer case, each vane assembly comprising:

a vane having an elongated airfoil body extending to a tip at a radially outer extremity, and a grommet disposed at the tip, the grommet being of a material more resilient than a material of the airfoil body, the grommet having an outer surface surrounding the tip, a radially-inner surface and a radially-outer surface, the tip of the vane having one or more apertures extending through the airfoil body, the material forming the grommet extending through the one or more apertures and being integrally formed therewithin, and one or more fastener slots extending through the tip of the airfoil body at a location radially outwardly from the one or more apertures, from the grommet and from the case; and an insert having a closed loop shape with a radially-outer edge and a radially-inner edge, the closed loop shape having an inner surface matingly shaped to receive the outer surface of the grommet, and an outer surface matingly shaped to be snugly received in a slot in the outer case, wherein one of the radially-outer edge and the radially-inner edge has an outwardly protruding lip shaped to abuttingly and sealingly engage a corresponding surface of the case around the slot, and the other one of the radially-inner edge and the radially-outer edge having hooks being resilient and inwardly flexible for engaging the insert into one end of the slot, the hooks being biased outwardly for engaging with a corresponding feature of the case, the insert being thereby trapped in the slot in position to snugly receive the grommet therein in a sealed engagement, and the insert having at least two insert fastener apertures disposed on opposite sides of the closed loop shape and aligned along a fastener axis; and a fastener engaging both the vane and the insert when the grommet is snugly received in the sealed engagement, the fastener extending through the at least two insert fastener apertures and the one or more fastener slots in the tip of the vane that is disposed between the at least two insert fastener apertures, the one or more fastener slots being defined in a portion of the tip of the vane protruding radially-outward from the grommet.

17. The vane assembly as defined in claim 1, wherein the one or more fastener slots in the tip of the airfoil body are aligned with the fastener axis of the at least two insert fastener apertures.

* * * * *